US011365088B2

(12) United States Patent
Sonnenmoser et al.

(10) Patent No.: US 11,365,088 B2
(45) Date of Patent: Jun. 21, 2022

(54) MONITORING DEVICE FOR A PASSENGER TRANSPORT SYSTEM, TESTING METHOD AND PASSENGER TRANSPORT SYSTEM

(71) Applicant: Inventio AG, Hergiswil (CH)

(72) Inventors: Astrid Sonnenmoser, Hochdorf (CH); Kurt Heinz, Buchs (CH)

(73) Assignee: INVENTIO AG, Hergiswil Nw (CH)

( * ) Notice: Subject to any disclaimer, the term of this patent is extended or adjusted under 35 U.S.C. 154(b) by 1036 days.

(21) Appl. No.: 16/062,132

(22) PCT Filed: Dec. 14, 2016

(86) PCT No.: PCT/EP2016/080965
§ 371 (c)(1),
(2) Date: Jun. 14, 2018

(87) PCT Pub. No.: WO2017/108525
PCT Pub. Date: Jun. 29, 2017

(65) Prior Publication Data

US 2018/0370764 A1 Dec. 27, 2018

(30) Foreign Application Priority Data

Dec. 21, 2015 (EP) ..... 15201447

(51) Int. Cl.
*G10H 5/00* (2006.01)
*B66B 5/00* (2006.01)
(Continued)

(52) U.S. Cl.
CPC ..... *B66B 5/0031* (2013.01); *B66B 1/3446* (2013.01); *B66B 5/0093* (2013.01); *B66B 13/22* (2013.01)

(58) Field of Classification Search
CPC ..... G06Q 50/30; B65G 2203/042; B66B 5/0031; B66B 13/22; B66B 1/3415;
(Continued)

(56) References Cited

U.S. PATENT DOCUMENTS 6,988,594 B2 1/2006 Deplazes et al.
7,325,657 B2 2/2008 Angst
(Continued)

FOREIGN PATENT DOCUMENTS

CN 1543425 A 11/2004
CN 1616335 A 5/2005
(Continued)

*Primary Examiner* — Marlon T Fletcher
(74) *Attorney, Agent, or Firm* — William J. Clemens; Shumaker, Loop & Kendrick, LLP

(57) ABSTRACT

A monitoring device for monitoring a passenger transport system includes at least one sensor, a control unit, a bus, and at least one bus node connected to the bus. The bus node has a microprocessor and an inspection unit for data exchange with the control unit. A first program module in the microprocessor detects a state change of the sensor that is connected to an input of the microprocessor via a transmission line and spontaneously transmits a corresponding state message to the control unit. A second program module in the inspection unit, after receiving an instruction from the control unit, transmits an activation signal to a coupling point in the bus node that simulates a state change of the sensor, the activation signal being superimposed on a sensor signal and/or being coupled into a power supply line connected to the sensor.

18 Claims, 6 Drawing Sheets

1 CODE-BEARING ELEMENT 3 CODE-READING ELEMENT 4/5 MICROPROCESSOR
8 SENSOR 10 CONTROL UNIT 30 BUS NODE

(51) Int. Cl.
*B66B 13/22* (2006.01)
*B66B 1/34* (2006.01)

(58) Field of Classification Search
CPC ..... B66B 3/00; B66B 5/0087; B66B 1/28; B66B 1/3407; B66B 5/0006; B66B 5/02; B66B 5/0018; B66B 5/0093; B66B 1/3446; B66B 29/00; B66B 5/0037; B66B 1/3423; B66B 29/005; B66B 5/0012; B66B 5/021; B66B 5/00
See application file for complete search history.

(56) References Cited

U.S. PATENT DOCUMENTS

| | | | | |
|---|---|---|---|---|
| 8,145,744 | B2 | 3/2012 | Gielis | |
| 8,443,944 | B2 | 5/2013 | Sonnenmoser et al. | |
| 8,688,284 | B2 | 4/2014 | Gerstenkorn | |
| 8,807,284 | B2 | 8/2014 | Sonnenmoser et al. | |
| 9,902,592 | B2 | 2/2018 | Sonnenmoser et al. | |
| 2006/0157305 | A1* | 7/2006 | DePlazes | B66B 13/22 187/391 |
| 2014/0032970 | A1* | 1/2014 | Hovi | B66B 5/0031 714/37 |
| 2014/0190773 | A1* | 7/2014 | Sonnenmoser | B66B 5/0006 187/247 |
| 2018/0370764 | A1* | 12/2018 | Sonnenmoser | B66B 1/3446 |
| 2019/0202659 | A1* | 7/2019 | Sudi | B66B 5/0087 |
| 2021/0155455 | A1* | 5/2021 | Herkel | B66B 5/0093 |

FOREIGN PATENT DOCUMENTS

| | | | |
|---|---|---|---|
| CN | 102016732 | A | 4/2011 |
| CN | 102795519 | A | 11/2012 |
| WO | 03107295 | A2 | 12/2003 |
| WO | 2009010410 | A1 | 1/2009 |
| WO | 2010097404 | A1 | 9/2010 |
| WO | 2013020806 | A1 | 2/2013 |

* cited by examiner

1 CODE-BEARING ELEMENT 3 CODE-READING ELEMENT 4/5 MICROPROCESSOR
8 SENSOR 10 CONTROL UNIT 30 BUS NODE

1 CODE-BEARING ELEMENT 3 CODE-READING ELEMENT 4/5 MICROPROCESSOR
8 SENSOR 10 CONTROL UNIT 30 BUS NODE

1 CODE-BEARING ELEMENT
3 CODE-READING ELEMENT 4/5 MICROPROCESSOR
8 SENSOR 10 CONTROL UNIT 30 BUS NODE 1a, 1b CODE-BEARING ELEMENT
3a, 3b CODE-READING ELEMENT
8a, 8b SENSOR 1a, 1b CODE-BEARING ELEMENT
3a, 3b CODE-READING ELEMENT
4/5 MICROPROCESSOR 8a, 8b SENSOR 10 CONTROL UNIT 30 BUS NODE 1a, 1b CODE-BEARING ELEMENT
3a, 3b CODE-READING ELEMENT
4/5 MICROPROCESSOR 8a, 8b SENSOR 10 CONTROL UNIT 30 BUS NODE 1a, 1b CODE-BEARING ELEMENT
3a, 3b CODE-READING ELEMENT
4/5 MICROPROCESSOR 8a, 8b SENSOR 10 CONTROL UNIT 30 BUS NODE

MONITORING DEVICE FOR A PASSENGER TRANSPORT SYSTEM, TESTING METHOD AND PASSENGER TRANSPORT SYSTEM

FIELD

The invention relates to a monitoring device for a passenger transport system, in particular an escalator, a moving walkway or an elevator system, a testing method for the monitoring device and a passenger transport system comprising a monitoring device of this kind.

BACKGROUND

Passenger transport systems of the aforementioned type comprise a control device, which processes operation-related signals of the passenger transport system and controls the drive motor in consideration of the operation-related signals. Operation-related signals come, for example, from the main switch of the passenger transport system, from various sensors, pulse generators, encoders and the like and from user interfaces, via which the users can make entries.

The control device comprises at least one computing unit, one main memory and one non-volatile memory having a control program that is required for open-loop and/or closed-loop control of the passenger transport system. Furthermore, a control device of this kind can contain interfaces and input modules necessary for servicing the passenger transport system and for diagnostics, and have a power pack for power supply.

Passenger transport systems further regularly comprise a safety system, which makes it possible to detect unauthorized or critical states of the passenger transport system using sensors and optionally to implement suitable measures, such as switching off the system. Safety circuits are often provided, in which a plurality of safety elements or sensors, such as safety contacts and safety switches, are arranged in a series circuit. The sensors monitor, for example, whether a shaft door or a car door of an elevator system is open. The passenger transport system can only be operated when the safety circuit and thus also all of the safety contacts integrated therein are closed. Some of the sensors are actuated by the doors. Other sensors, such as an overtravel switch, are actuated or triggered by moving parts of the system. The safety circuit is connected to the drive or the brake unit of the passenger transport system in order to interrupt the travel operation if the safety circuit is opened.

However, safety systems comprising safety circuits have various disadvantages. On account of the length of the connections, an undesirably large voltage drop can occur in the safety circuit. The individual safety contacts are relatively susceptible to faults, which is why unnecessary emergency stops can occur. In addition, the safety circuit does not make possible any specific diagnosis, since when the safety circuit is open, it cannot be established which sensor or switch caused said safety circuit to open. It has therefore been proposed to equip passenger transport systems with a monitoring device comprising a bus system rather than a safety circuit.

WO 2013/020806 A1 describes a monitoring device comprising a control unit and at least one bus node. Said bus node comprises a first microprocessor and a second microprocessor. The control unit and the bus node communicate via a bus. Furthermore, the first microprocessor and the second microprocessor are connected in an uninterrupted manner via a signal line. A test method for checking the bus node comprises the following steps: a default signal is transmitted by the control unit to the first microprocessor, the first microprocessor transmits the signal to the second microprocessor and the second microprocessor provides the signal to the control unit. Finally, the control unit verifies whether the provided signal corresponds to a signal expected by the control unit.

WO 03/107295 A1 discloses a monitoring device that is equipped with a bus system and by means of which the states of peripheral devices, e.g. of components of an elevator system, can be monitored. For this purpose, the bus system comprises a bus, a central control unit, which is connected to the bus, and a plurality of peripheral devices. Each of said devices is located at a bus node and communicates with the control unit via the bus. The peripheral devices assume a particular state at any point in time. The control unit periodically polls the state of each peripheral device via the bus.

However, the periodic polling of the state of the peripheral devices via the bus has an adverse effect. Since the control unit actively polls each peripheral device, the bus transmits two signals or data packets, one polling signal and one response signal per polling operation and peripheral device. In the case of relatively short polling cycles, especially in the case of a large number of safety-related peripheral devices, a large number of signals is exchanged between the control unit and the peripheral devices. This means that the control unit must have a high computing capacity in order to process all the signals. Furthermore, the bus is heavily loaded and provides high signal-transmission capacities in order to transmit all the state inquiries. Accordingly, the control unit and the bus are expensive. On account of the limited capacity, the number of bus nodes that can be integrated in the bus system is additionally severely restricted.

WO 2010/097404 A1 discloses a monitoring device comprising a control unit, a bus and bus nodes connected thereto, each bus node comprising a first microprocessor which monitors the state of a sensor and, when the state of the sensor changes, spontaneously transmits a state change message to the control unit via the bus. On account of the bus nodes spontaneously notifying the control unit of the changes of state, polling the state of the sensors at the bus nodes can be dispensed with in this monitoring device. The data traffic at the bus is drastically reduced. Provided that a bus node is connected to a sensor that monitors the state of part of a passenger transport system, e.g. a shaft cover, which is opened only in the event of servicing, the state does not have to be polled every few seconds, but rather is spontaneously reported, if servicing is being carried out.

However, on account of the relatively long rest periods, an inspection module is provided in each bus node, which inspection module is implemented in the first or a second microprocessor. In order to inspect the bus node, the control unit transmits an instruction via the bus to the inspection module at relatively large time intervals to interrupt the signal transmission from the sensor to the first microprocessor, such that the first microprocessor detects a state change and sends a state message to the control unit. In order to be able to produce state changes, a switch is inserted in the transmission line between the sensor and the first microprocessor, by means of which switch the signal transmission can be interrupted. Alternatively, the switch is arranged in a power supply line connected to the sensor, such that the power supply can be interrupted. By actuating the switch installed in this manner, a state change can be induced at the sensor.

However, a disadvantage of this solution is the relatively high circuit complexity on account of the incorporation of an additional switch. The switch itself is in turn a source of errors that can also cause an error state when there is a fault. On account of noticeable transmission losses, it is also undesirable to integrate a switch into a transmission line. The actuation of the switch also takes time, which is generally undesirable. It should further be noted that, in order to actuate the switch, energy is required which is not necessarily present in the required amount if the bus nodes are supplied via the bus.

SUMMARY

An object of the present invention is therefore to provide an improved monitoring device for a passenger transport system, a testing method for the monitoring device and a passenger transport system comprising a monitoring device of this kind.

The monitoring device, which is used to monitor a passenger transport system, comprises at least one sensor, a control unit, a bus, at least one bus node connected to the bus and that comprises a first microprocessor and an inspection unit which is implemented in the first microprocessor or in a second microprocessor. Furthermore, communication means are provided in the control unit, in the first microprocessor and in the inspection unit, by means of which data can be transmitted at least from the control unit to the inspection unit and from the first microprocessor to the control unit. A first program module is further provided in the first microprocessor, by means of which a state change of the sensor connected to an input of the first microprocessor via a transmission line can be detected and a corresponding state message can be transmitted spontaneously to the control unit.

According to the invention, the inspection unit comprises a second program module that is designed such that, after receiving an instruction from the control unit, an activation signal can be transmitted to a coupling point within the bus node, the activation signal being superimposed on a sensor signal and/or being coupled into a power supply line connected to the sensor. A state change of the sensor can therefore be simulated without a line in the form of a signal and/or power supply line being interrupted. A "signal line" should be understood to mean any line in the form of a physical cable that can transmit digital or analog signals.

In the present monitoring device, no continuous polling of the state signals received from the first microprocessor is carried out by the control unit. Provided that the first microprocessor is functional, it is sufficient for a state message to be transmitted to the control unit when a state change of the sensor occurs that indicates a potentially dangerous state of the passenger transport system, for example. This reduces the number of signals to be transmitted and processed. More cost-efficient bus systems can therefore be used.

In order to check that the monitoring device is operating smoothly, the control unit sends instructions to the bus nodes at larger time intervals, by means of which instructions state changes of the sensor are simulated and state messages are generated.

If the control unit receives no state message from the relevant bus node after sending out the instruction, it is assumed that at least in the first microprocessor or in the inspection unit, which is implemented in the first or a second microprocessor, or in an additional component, an error function has occurred, and the state monitoring is no longer secure.

After receiving the instruction from the control unit, e.g. a telegram or a data frame having the address of the relevant bus node, the inspection unit triggers the activation signal or the activation signals and transmits same to the coupling point inside the bus node.

The sensor is designed to emit digital sensor signals, such as an identification code, and/or analog sensor signals at the output thereof, which signals are monitored in the first microprocessor with regard to the occurrence of a state change. State changes of the sensor are, for example, the elimination or alteration of a pending code, logical signal, AC voltage signal, serial or parallel data stream or a significant change in the voltage level.

The inspection unit is designed to emit digital activation signals and/or analog activation signals at the output thereof, for example DC voltage pulses, logic signals, AC voltage signals, preferably AC voltage signals in the frequency range of 500 Hz to 2000 Hz.

By means of the brief action of the activation signals on the coupling point, in that the activation signal is superimposed on the sensor signal and/or is coupled into a power supply line connected to the sensor, a state change of the sensor signals is produced at the input of the first microprocessor, which is then reported to the control unit.

By means of a brief activation signal, it is therefore possible to test the bus node quickly and efficiently. The control unit can address all bus nodes sequentially and prompt the inspection units at said bus nodes to emit an activation signal in order to bring about the desired state change. It is not necessary to install a switch that must be opened and closed again and that can cause faults, due to bouncing, aging or oxidation, or that can fail completely.

The bus node can therefore be easily tested with less effort, in a very short time and without additional risks.

The coupling point is arranged, for example, within the output stage of the sensor or within the input stage of the first microprocessor or between the output stage of the sensor and the input stage of the first microprocessor. The activation signals are thus superimposed on the sensor signal, as a result of which a state change of the sensor is simulated.

The coupling point can also be arranged at the input of the sensor or inside the sensor, provided that electrical signals occur there. The activation signals typically have maximum effect at the input of or inside the sensors. Electrical signals of this kind can also be referred to as sensor signals.

Furthermore, the activation signals can also be coupled into the power supply lines connected to the sensor. This also causes the sensor to become unstable, which is perceived as a state change.

The at least one coupling point can be designed in various ways and thus be adapted to the relevant requirements. The coupling point and thus the monitoring device according to the invention are therefore very versatile.

The at least one coupling point can be designed as a galvanic connection or can comprise at least one coupling capacitor for capacitive coupling, or at least one coil for inductive coupling. The activation signals can therefore be coupled in a simple manner.

Provided that the sensor transmits data or a code to the first microprocessor, a data change or code change can also be effected by means of the activation signals. For example, at least one data bit is changed such that the first microprocessor identifies a data change or state change and reports this to the control unit.

The coupling point can advantageously be designed as a logic circuit, in which the digital sensor signals and the digital activation signals can be combined. The logic circuit is preferably an inverter, which can be switched over by means of the activation signals. An EXOR gate is provided for every data bit of the sensor signal, for example. The data bit is applied to one input and the activation signal is applied to the other input of the EXOR gate. By switching the activation signal from logic "0" to logic "1", the sensor signal can be selectively inverted.

Provided that an identification code and the corresponding inverted data set are assigned to each network node in the control unit, and the identification code or the inverted value thereof is transmitted to the control unit, the control unit can thus establish which of the bus nodes has received the state message, and whether the state message has been triggered by an actual or a simulated state change in said bus node.

The monitoring device is suitable for monitoring any type of sensor. Particularly advantageously, sensors can be used which comprise at least one code-bearing element and at least one code-reading element, such that the code-reading element can read an identification code from the code-bearing element in a contactless manner and send said code to the first microprocessor. The coupling point can advantageously be arranged at the input or at the output of the code-reading element.

The code-bearing element and the code-reading element preferably each have an induction loop, the code-reading element providing the code-bearing element with electromagnetic energy in a contactless manner by means of the two induction loops and the code-bearing element transmitting the identification code thereof to the code-reading element in a contactless manner by means of the two induction loops. The activation signals can in this case advantageously be galvanically or inductively coupled into one of the two induction loops.

In a preferred embodiment, at least one code-bearing element and at least one code-reading element are assigned to the bus node in a passenger transport system. The code-reading element reads an identification code from the code-bearing element in a contactless manner and sends a signal to the first microprocessor.

Preferably, the code-bearing element and the code-reading element each have an induction loop. The code-reading element provides the code-bearing element with electromagnetic energy in a contactless manner by means of the two induction loops. The code-bearing element transmits the identification code thereof to the code-reading element in a contactless manner by means of the two induction loops.

In this embodiment, the monitoring device according to the invention allows contactless state monitoring of system components. The sensors comprising the code-bearing and code-reading element hardly wear out during operation, as a result of which maintenance costs can be reduced and the monitoring security can be increased.

DESCRIPTION OF THE DRAWINGS

The invention will be described below with reference to drawings, in which.

DETAILED DESCRIPTION

Figure 1:
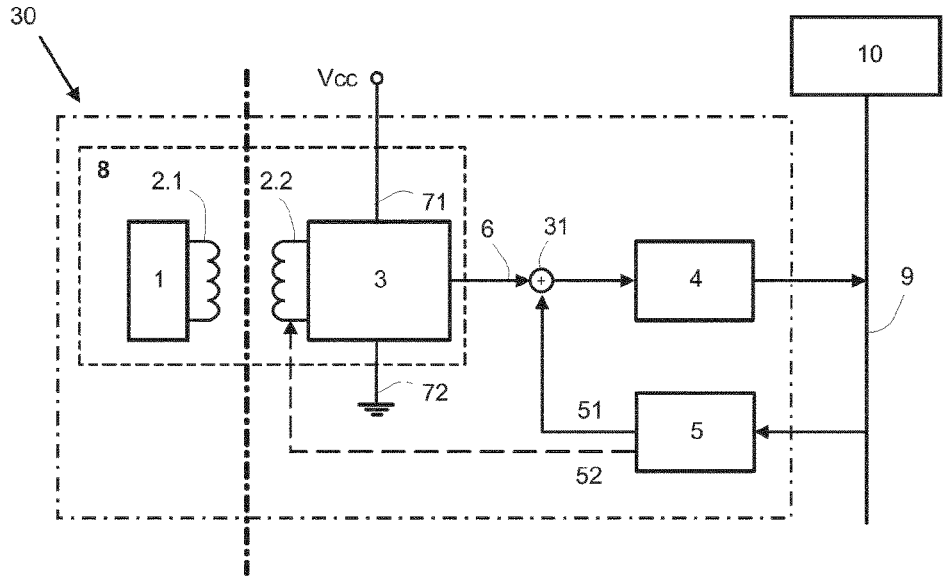
FIG. 1 shows a monitoring device according to the invention comprising a control unit 10, which is connected to a bus node 30 via a bus 9, in which bus node a sensor 8 is connected to the input of a first microprocessor 4 via a coupling point 31, into which an activation signal can be coupled by an inspection unit or a second microprocessor 5.

FIG. 1 shows a first embodiment of the monitoring device, which can advantageously be used in a passenger transport system. The monitoring device comprises a control unit 10, which communicates with at least one bus node 30 via a bus 9. The control unit 10, the bus 9 and the at least one bus node 30 form a bus system, within which each bus node 30 has a unique identifiable address. By means of this address, signals, in particular control commands from the control unit 10, can be transmitted to a particular bus node 30 in a targeted manner. Similarly, incoming signals at the control unit 10 can be uniquely allocated to a bus node 30.

Data can therefore be sent in both directions between the bus node 30 and the control unit 10 via the bus 9. Using said data, state changes that are detected by a sensor 8 can be reported to the control unit 10. Upon occurrence of state changes, corresponding messages are in each case spontaneously transmitted from the nodes 30 to the control unit. The control unit 10 therefore does not have to carry out periodic polling in order to determine whether state changes have occurred, but rather is informed thereof spontaneously by the bus nodes 30. If no state changes occur, no corresponding data are transmitted via the bus 9. The data traffic through the bus 9 is thus substantially reduced. The control unit 10, merely for the purpose of inspecting the bus nodes 30, regularly sends instructions to said bus nodes 30 in order to bring about a state change that leads to a message. The integrity of the bus nodes and of the entire bus system can be regularly tested by sending instructions and receiving corresponding state change messages.

For this purpose, the bus node 30 comprises a first microprocessor 4, by means of which state change messages can be transmitted to the control unit 10. Furthermore, an inspection unit in the form of a second microprocessor 5 is provided, which receives control commands or instructions from the control unit 10, by means of which tests are initiated. In order to be able to perform the tasks mentioned, corresponding program modules and communication means are provided in the two microprocessors 4 and 5.

The two microprocessors 4, 5 can be configured both physically and virtually. In the case of two physically configured microprocessors 4, 5, two microprocessors 4, 5 are arranged on a die, for example. In an alternative embodiment, the two microprocessors 4, 5 can each be produced on their own die. However, it is also possible for only one microprocessor 4 to be physically present. In this case, a second microprocessor 5 or the inspection unit can be virtually configured by means of software on the first physically present microprocessor 4.

Any kind of sensor can be monitored by means of the bus nodes 30. In the embodiments, sensors 8 are shown which comprise a code-bearing element 1 and a code-reading element 3. Preferably, the code-bearing element 1 is an RFID tag 1 and the code-reading element 3 is an RFID reader 3. Other technical options are available to a person skilled in the art seeking to achieve contactless transmission of an identification code between a code-bearing and code-reading element. Alternatively, combinations of code-bearing and code-reading elements 1, 3 consisting of a barcode carrier and laser scanner, loudspeaker and microphone, magnetic tape and Hall sensor, magnet and Hall sensor, or light source and light-sensitive sensor, can also be used, for example.

Both the RFID tag 1 and the RFID reader 3 have an induction loop 2.1, 2.2. The RFID reader 3 supplies electromagnetic energy to the RFID tag 1 by means of said induction loops 2.1, 2.2. For this purpose, the RFID reader 3 is connected to a power or voltage source Vcc. If the RFID tag 1 is supplied with energy, the RFID tag 1 sends an identification code stored on the RFID tag 1 to the RFID reader 3 via the induction loops 2.1, 2.2. The energy supply Vcc of the RFID tag 1 is only guaranteed if the RFID tag 1 is in physical proximity under a critical distance from the RFID reader 3 and the induction loop 2.1 of the RFID tag 1 can be excited by means of the induction loop 2.2 of the RFID reader 3. The energy supply of the RFID tag 1 therefore only functions below a critical distance from the RFID reader 3. If the critical distance is exceeded, the RFID tag 1 does not draw enough energy to maintain the transmission of the identification code to the RFID reader 3.

The RFID reader 3 transmits the received identification code via a data conductor 6 to the first microprocessor 4, which compares the identification code with a list of identification codes stored on a memory unit. During said comparison, the microprocessor 4 calculates a state value according to stored rules on the basis of the identification code. Said state value can have a positive or a negative value. A negative state value is generated, for example, when no identification code or a false identification code is transmitted to the microprocessor 4.

In the case of a negative state value, the microprocessor 4 sends a state change message to the control unit 10 via the bus 9. Said state change message contains at least the address of the bus node 30 and preferably the identification code of the detected RFID tag 1. By virtue of the notified address, the control unit 10 is capable of localizing the origin of the negative state value and initiating a corresponding reaction.

The bus node 30 monitors the state of a shaft door, for example. The RFID tag 1 and the RFID reader 3 are arranged in the region of the shaft door, such that the distance between the RFID tag 1 and the RFID reader 3 is below the critical distance when the shaft door is closed. The microprocessor 4 thus receives the identification code from the RFID reader 3 and generates a positive state value. If the shaft door is opened, the RFID tag 1 and the RFID reader 3 exceed the critical distance. Since the RFID tag 1 is in this case no longer supplied with electrical energy by the RFID reader 3, the RFID tag 1 ceases transmission of the identification code thereof and the microprocessor 4 generates a negative state value. Accordingly, the microprocessor 4 sends a state change message to the control unit 10. The control unit 10 localizes the open shaft door using the address of the bus node 30. If said shaft door is open without authorization, for example if there is no elevator car in the shaft door region, the control unit 10 initiates a reaction in order to bring the elevator system into a safe state.

The state of any given components, such as door locks, cover locks, emergency stop switches, or travel switches, of a passenger transport system, in particular an escalator or an elevator system, can therefore be monitored by means of the RFID tag 1 and RFID reader 3 of a bus node 30.

Furthermore, other sensors 8 may be used which operate according to different physical principles and the state changes of which are reported to the control unit 10 in another way. In particular, the invention does not depend on data transmission protocols used for the entire bus system. Similarly, the invention does not depend on the way in which the sensor signals that can be compared with any given reference values and threshold values are analyzed in order to establish a change of state. The transmission of an identification code from the sensor 8 to the first microprocessor 4 is advantageous but it is not strictly necessary.

The secure operation of the bus nodes 30 depends primarily on the functionality of the microprocessor 4. Therefore, the bus node 30 is regularly tested by the control unit 10 in order to check the spontaneous transmission behavior of the microprocessor 4 when the state of the sensor 8 changes.

In order to test the bus node 30 according to FIG. 1, the control unit 10 sends a control command or an instruction via the bus 9 to the inspection unit 5 or the second microprocessor 5 in order to trigger or simulate a state change of the sensor 8 that prompts the first microprocessor 4 to send off a state change message.

For this purpose, a coupling point 31 is provided in the circuit arrangement of the bus node 30, into which coupling point an activation signal is galvanically, capacitively or inductively coupled. The activation signal is generated by the inspection unit, for example by the second microprocessor 5, and is transmitted via a connection line 51 to the coupling point 31, which is arranged in a transmission line 6 in the configuration from FIG. 1, which transmission line connects the output of the sensor 8 to the input of the first microprocessor 4. A second connection line 52 is shown by a dashed line, via which activation signals can be transmitted into the sensor 8 to the second coupling coil 2.2 (the coupling point is not shown). The signals emitted by the sensor 8 are superimposed by the activation signal in the first coupling point 31. For example, the identification code is serially transmitted via the transmission line 6 as a pulse train. At least one of the data bits of the pulse train is modified by means of the activation signal, and therefore the expected identification signal is not received in the first microprocessor 4 and a change of state is established.

The first coupling point 31 can also be designed as a circuit logic to which the sensor signal is supplied at a first input and to which the activation signal is supplied at a second input. For example, the data bits of the identification code are supplied to a first input of an EXOR gate in each case, the activation signal being applied to the second input thereof. As soon as the activation signal is set to logic "1", the identification code is inverted by the EXOR logic. Therefore, instead of the identification code, the first microprocessor 4 can transmit the inverted identification code to the control unit 10. The control unit 10 therefore identifies in each case whether the bus node 30 reports a spontaneous or simulated state change.

The test is carried out recurrently for each bus node 30. Since, during the test, the control unit 10 cannot identify any real information about the state of the tested bus node 30, the testing time is kept as short as possible and the test is only carried out as often as necessary. The frequency of the tests depends primarily on the probability of failure of the overall system. The more reliable the overall system, the more rarely said system can be tested in order to ensure secure monitoring of the state of an elevator component. In general, the test is carried out at least once daily.

The method according to the invention makes it possible to carry out the test within a very short time, since even the deletion of a single data bit of the identification code or a short pulse-like interruption of the sensor signal is sufficient to simulate a change of state. Opening and closing a switch and the problems associated with the switch are avoided.

In the following, further embodiments of the monitoring device, in particular of the bus node 30, are described. Since the basic design of the bus node 30 and the functioning of the bus components 1 to 5 are comparable in these embodiments, the differences in design and functioning of the different bus nodes 30 will substantially be explained.

Figure 2:
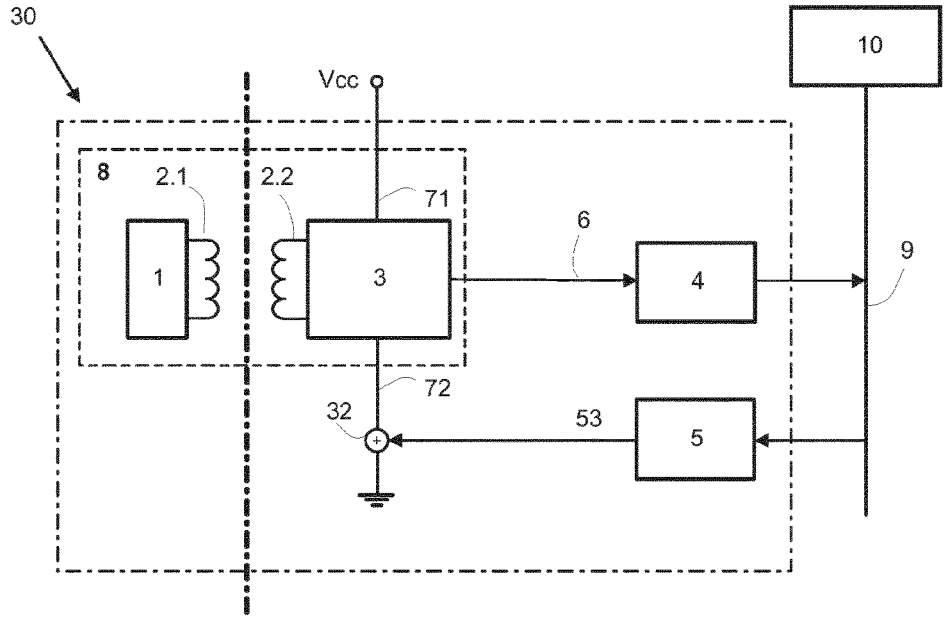
FIG. 2 shows the monitoring device from FIG. 1, comprising a coupling point 32 that is arranged inside the power supply line 71, 72 of the sensor 8.

FIG. 2 shows the monitoring device from FIG. 1, comprising a coupling point 32 in the power supply line 71, 72 of the sensor 8. By impressing the activation signal from the second microprocessor 5 into the power supply line 71, 72 via the connection line 53, the function of the sensor 8 is interrupted for a short time, and therefore a change of state occurs, which is identified in the first microprocessor 4. The interruption may in turn be effected in a pulse-like manner within a very short time with minimal effort.

Figure 3:
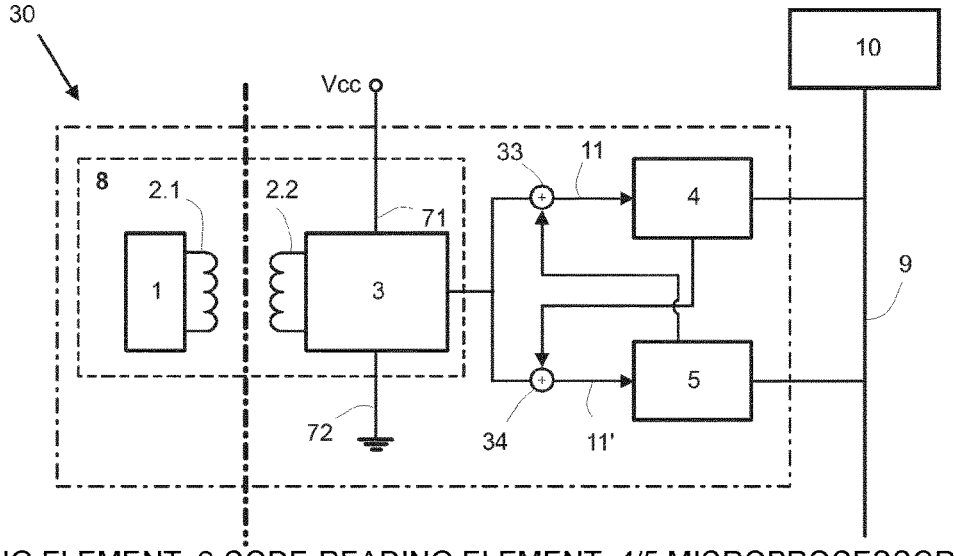
FIG. 3 shows the monitoring device from FIG. 1, in which the output signal of the sensor 8 is supplied to the first microprocessor 4 and the second microprocessor 5 via transmission lines 11, 11' that are each provided with a coupling point 33, 34.

FIG. 3 shows a third embodiment of the monitoring device. In this embodiment, the output signal of the sensor 8 is transmitted to the first microprocessor 4 via a first transmission line 11, which is provided with a first coupling point 33, and to the second microprocessor 5 via a second transmission line 11', which is provided with a second coupling point 34. The output signal of the sensor 8 or the transmitted identification code can be analyzed redundantly by the two microprocessors 4, 5. Therefore, if one of the two microprocessors 4, 5 generates a negative state value, a state change message is transmitted to the control unit 10 by the bus node 30. An advantage of this embodiment is the redundant and thus very reliable analysis of the sensor signal, for example of the identification code.

In order to test the bus node 30, activation signals can be transmitted from the first microprocessor 4 to the second coupling point 34 and from the second microprocessor 5 to the first coupling point 33. During testing of one of the two microprocessors 4, 5, the microprocessor 4, 5 that triggers the activation signals continues to read the real identification code of the RFID tag 1. In contrast with the embodiments described above, the bus node 30 therefore remains capable of identifying actual state changes and of sending state change messages to the control unit 10. The control unit 10 can therefore distinguish between simulated and actual state changes when it receives two state change messages at the same time.

Figure 4:
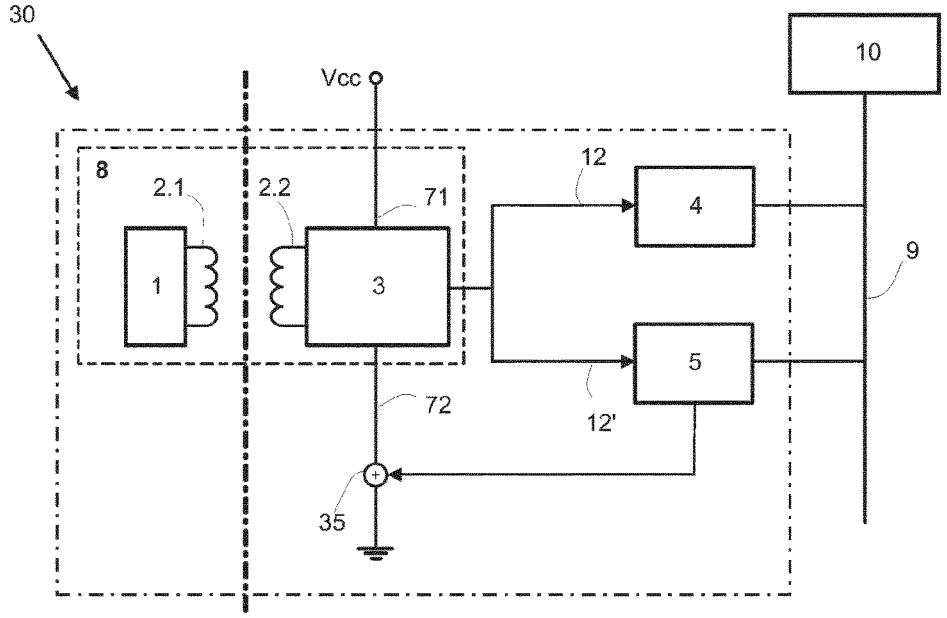
FIG. 4 shows the monitoring device from FIG. 2, in which the output signal of the sensor 8 is supplied to the first microprocessor 4 and the second microprocessor 5 via transmission lines 12, 12' and in which a coupling point 35 is provided in the power supply line 71, 72 of the sensor 8.
Figure 5:
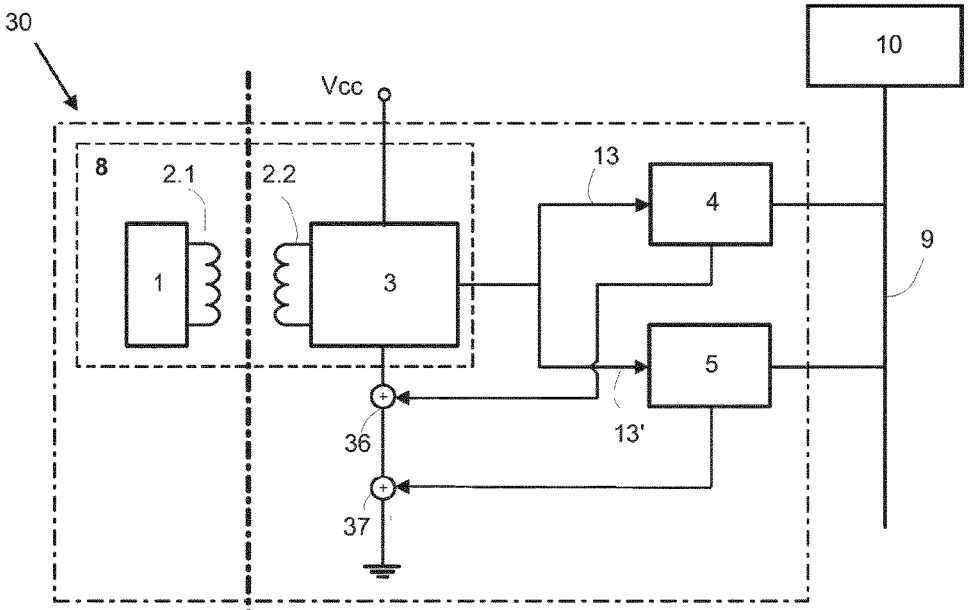
FIG. 5 shows the monitoring device from FIG. 4, in which a first coupling point 36, which is actuated by the first microprocessor 4, and a second coupling point 37, which is actuated by the second microprocessor 5, are provided in the power supply line 71, 72 of the sensor 8.

FIG. 4 and FIG. 5 show a fourth and fifth embodiment of the monitoring device. According to these embodiments, the output signal of the sensor is transmitted via transmission lines 12, 12' or 13, 13' to the two microprocessors 4, 5 for redundant analysis.

In the fourth embodiment, the control unit 10, for the purpose of testing the bus node 30, sends a control command to the second microprocessor 5 in order to trigger the emission of an activation signal to the coupling point 35, which is integrated in the power supply line 72.

By impressing the activation signal into the power supply line 71, 72, the function of the sensor 8 is interrupted for a short time, and therefore a change of state occurs, which is identified in the first microprocessor 4. The interruption may in turn be effected within a very short time with minimal effort.

In the fifth embodiment, a first coupling point 36, which is actuated by the first microprocessor 4, and a second coupling point 37, which is actuated by the second microprocessor 5, are provided in the power supply line 71, 72 of the sensor 8. When the state of the sensor 8 changes, for example in the absence of the identification code signal, both the first and the second microprocessor 4, 5 send a state change message to the control unit 10.

In the embodiments according to FIGS. 6 to 12, the output signals are transmitted from two sensors 8*a*, 8*b* via different transmission lines to at least one of the microprocessors 4, 5. The coupling points used to test the bus node are arranged at different points within the circuit arrangements 30. The sensors 8*a*, 8*b* comprise corresponding code-bearing elements 1*a*, 1*b*, code-reading elements 3*a*, 3*b* and induction loops 2.1*a*, 2.2*a*, 2.1*b*, 2.2*b*. The functioning of the sensors is analogous to that of the sensors of the embodiments from FIGS. 1 to 5. The code-reading elements 3*a*, 3*b* are supplied via power supply lines (not marked in greater detail) analogous to the power supply lines 71, 72 of the previous embodiments according to FIGS. 1 to 5.

Bus nodes 30 that have two sensors 8*a*, 8*b* can either redundantly monitor the state of an element of a passenger transport system or monitor the states of two physically adjacent elements of the passenger transport system. For example, the state of a shaft door is monitored redundantly in an elevator system by means of two sensors or the state of a car door is monitored on the one hand and the state of an alarm button is monitored on the other.

Figure 6:
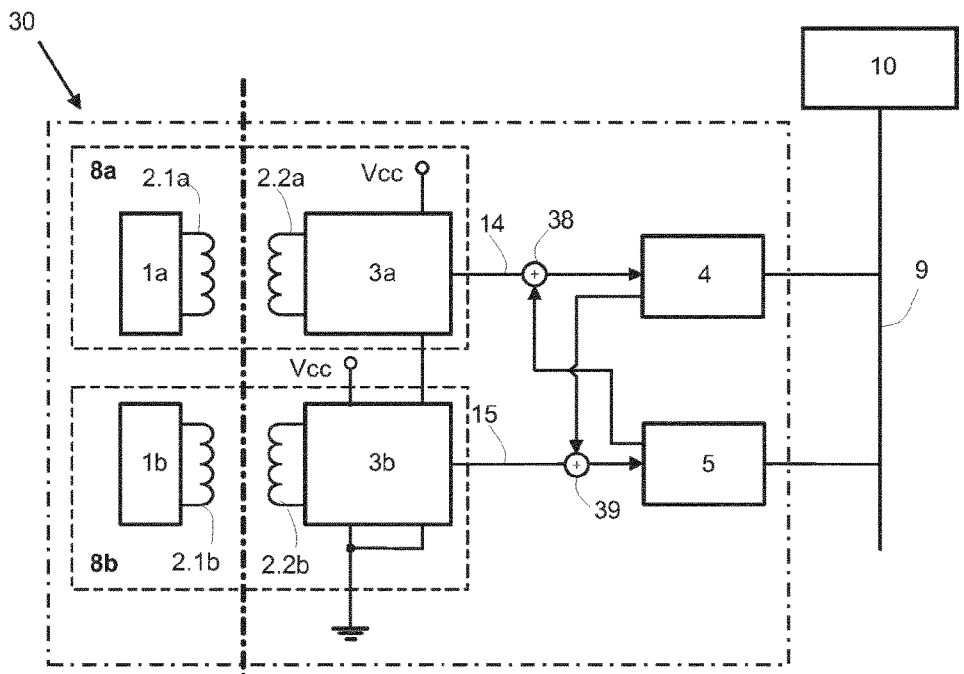
FIG. 6 shows a monitoring device according to the invention comprising a first sensor 8*a*, which is connected to the first microprocessor 4 via a first transmission line 14, and a second sensor 8*b*, which is connected to the second microprocessor 5 via a second transmission line 15, and comprising a first coupling point 38 in the first transmission line 14 to which activation signals can be supplied by the second microprocessor 5, and a second coupling point 39 in the second transmission line 15 to which activation signals can be supplied by the first microprocessor 4.

In the embodiment from FIG. 6, the first sensor 8*a* is connected to the first microprocessor 4 via a first transmission line 14 and the second sensor 8*b* is connected to the second microprocessor 5 via a second transmission line 15. A first coupling point 38 is provided in the first transmission line 14, to which coupling point activation signals can be supplied by the second microprocessor 5. A second coupling point 39 is provided in the second transmission line, to which coupling point activation signals can be supplied by the first microprocessor 4.

Figure 7:
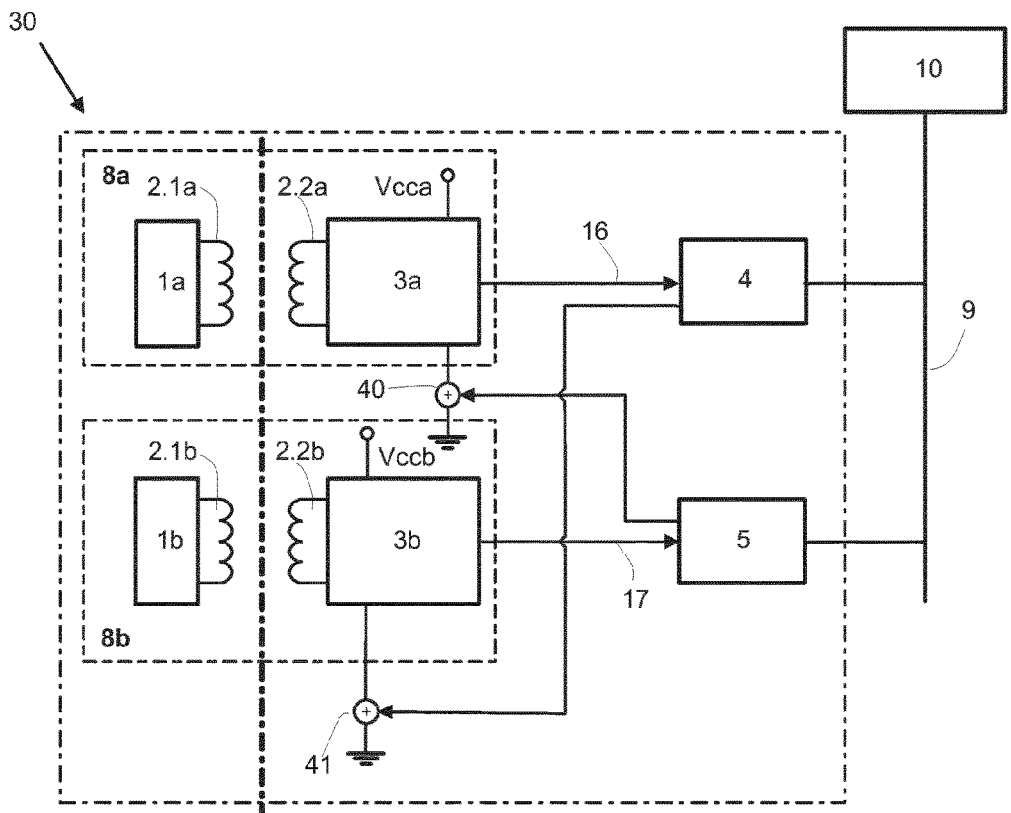
FIG. 7 shows the monitoring device from FIG. 6, comprising the first coupling point 40 in the power supply line of the first sensor 8*a* and the second coupling point 41 in the power supply line of the second sensor 8*b;*

FIG. 7 shows the monitoring device from FIG. 6, comprising a first coupling point 40, actuated by the second microprocessor 5, in a power supply line of the first sensor 8*a* and comprising a second coupling point 41, actuated by the first microprocessor 4, in a power supply line of the second sensor 8*b*. The state change of the sensors 8*a* and 8*b* is thus caused by impairment of the power supply. The first sensor 8*a* is connected to the first microprocessor 4 via a first transmission line 16 and the second sensor 8*b* is connected to the second microprocessor 5 via a second transmission line 17.

Figure 8:
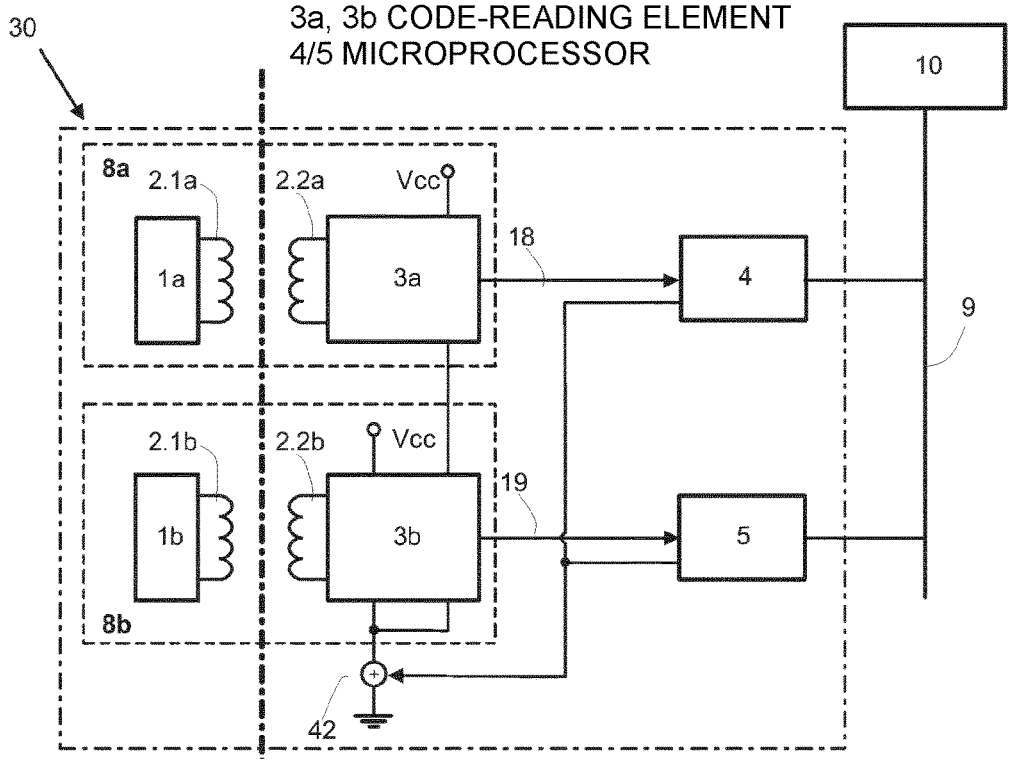
FIG. 8 shows the monitoring device from FIG. 7, comprising a common power supply for the two sensors 8*a*, 8*b*, and comprising only one coupling point 42 in a common power supply line, to which coupling point activation signals can be applied by the two microprocessors 4, 5.

In the embodiment according to FIG. 8, however, both microprocessors 4, 5 send activation signals to a single coupling point 42, which is provided in a power supply line common to both sensors 8*a*, 8*b*. The first sensor 8*a* is connected to the first microprocessor 4 via a first transmission line 18 and the second sensor 8*b* is connected to the second microprocessor 5 via a second transmission line 19.

Figure 9:
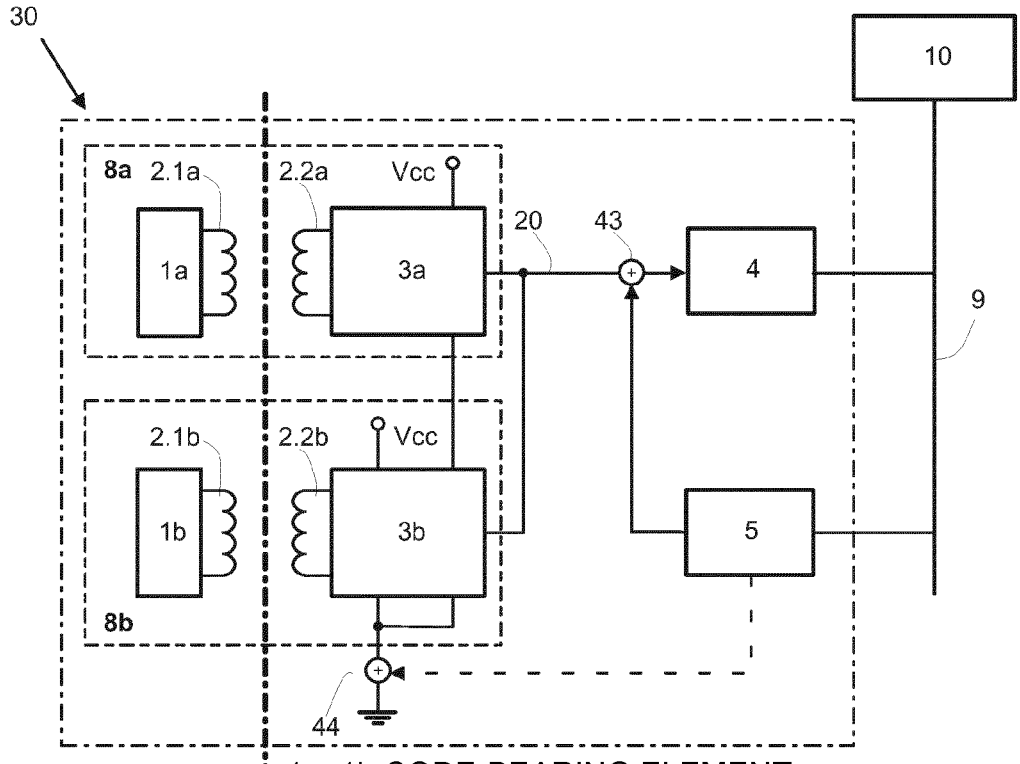
FIG. 9 shows the monitoring device from FIG. 8, in which the two sensors 8*a*, 8*b* are connected to the first microprocessor 4 via a common transmission line 20, comprising a first coupling point 43 in the common transmission line 20 and a second coupling point 44 in the common power supply line of the two sensors 8*a*, 8*b*, to which coupling points activation signals can be applied by the second microprocessor 5.

FIG. 9 shows an embodiment in which the output signals are transmitted from two sensors 8*a*, 8*b* to the first microprocessor 4 via a common transmission line 20. The second microprocessor 5 tests the functionality of the first microprocessor 4 by transmitting activation signals to a coupling point 43 that is integrated in the transmission line 20. In an alternative arrangement, a coupling point 44, which is actuated via a second connection line (see the dashed line), is provided in a common power supply line of the sensors 8*a*, 8*b*.

Figure 10:
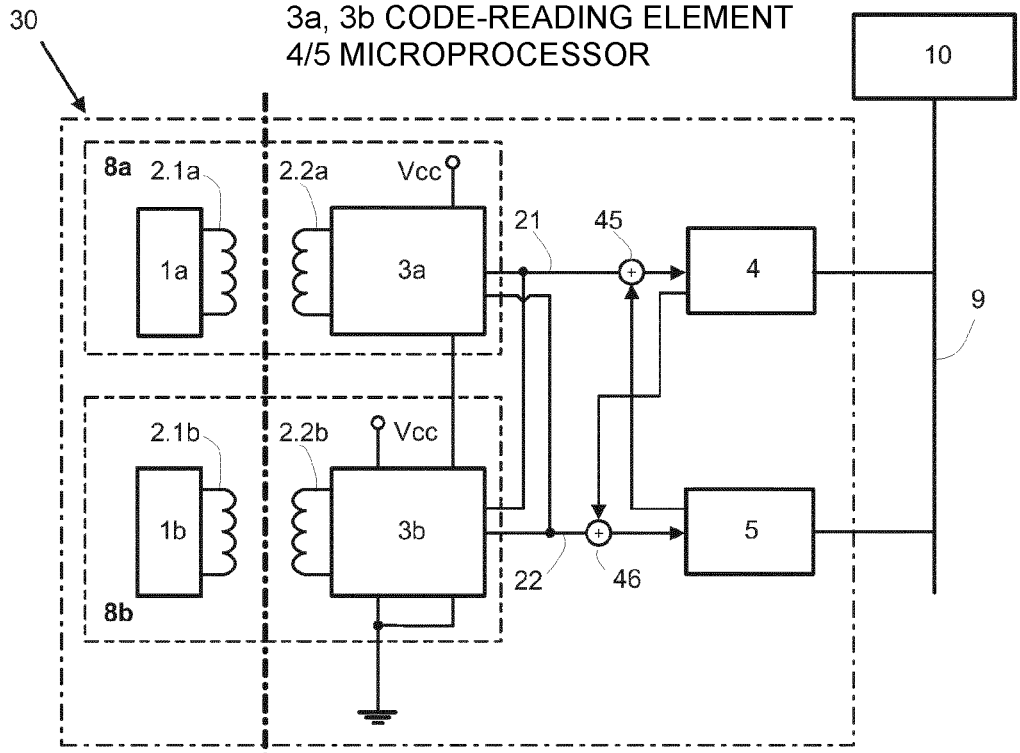
FIG. 10 shows the monitoring device from FIG. 6, in which the two sensors 8*a*, 8*b* are each connected to the first microprocessor 4 via a first transmission line 21 and to the second microprocessor 5 via a second transmission line 22, and comprising a first coupling point 45 in the first transmission line 21 to which activation signals can be applied by the second microprocessor 5, and comprising a second coupling point 46 in the second transmission line 22 to which activation signals can be applied by the first microprocessor 4.
Figure 11:
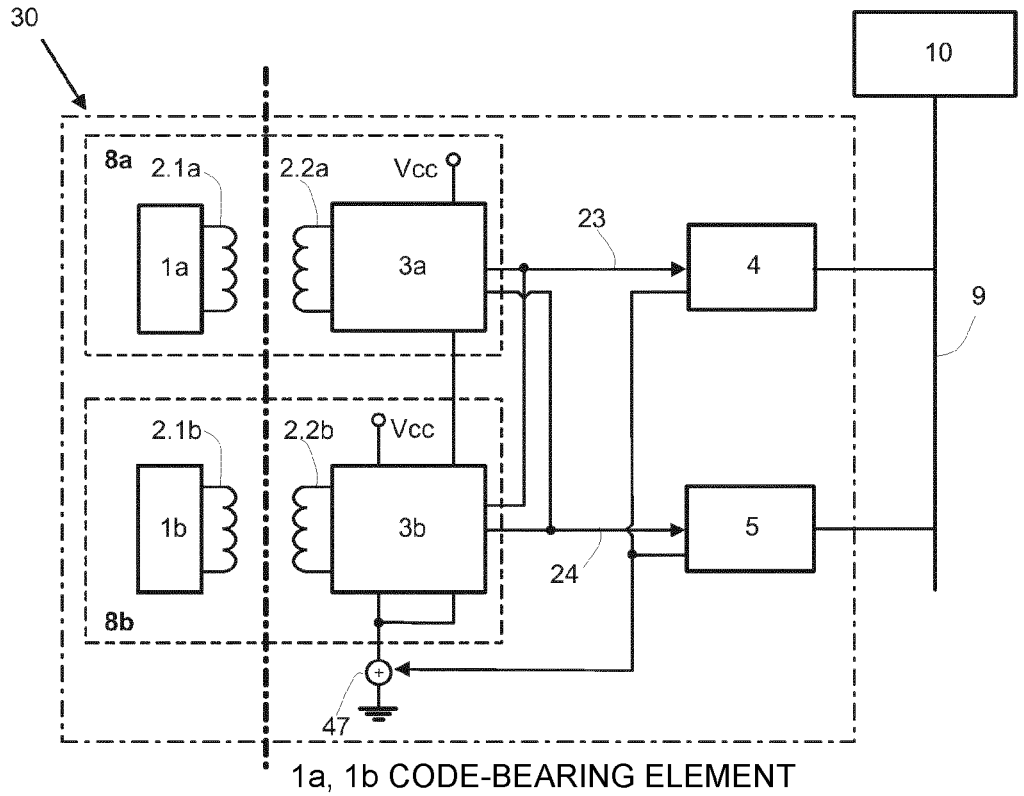
FIG. 11 shows the monitoring device from FIG. 10, comprising only one coupling point 47 in a common power supply line of the two sensors 8*a*, 8*b*, to which coupling point activation signals can be applied by the two microprocessors 4, 5.
Figure 12:
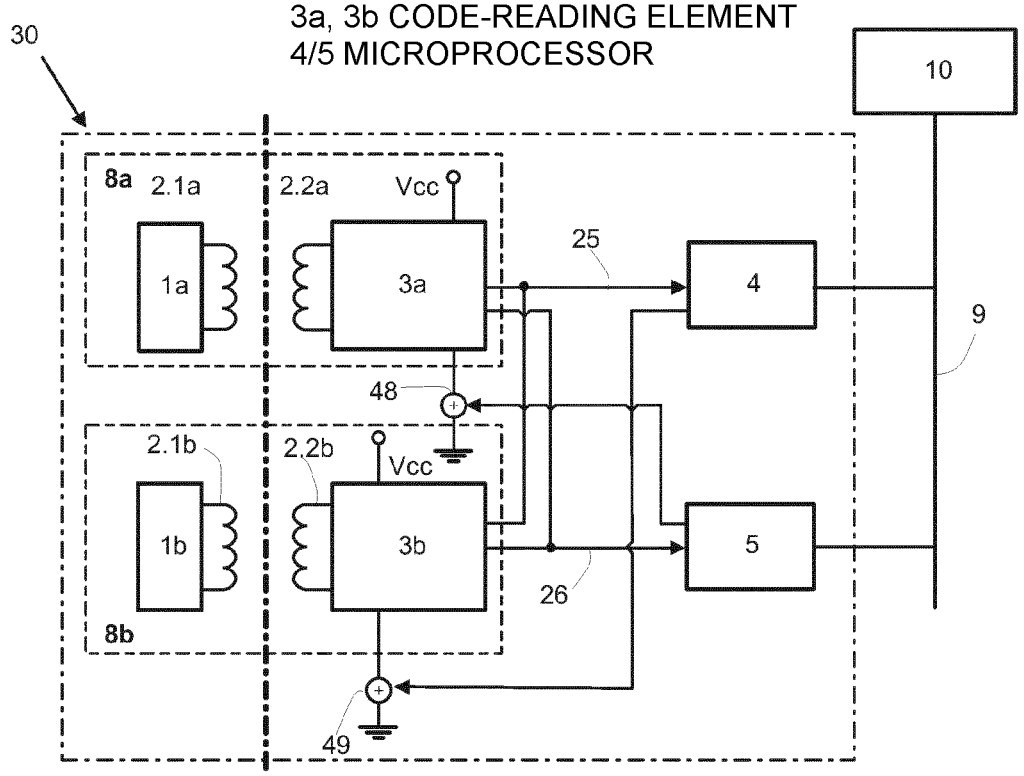
FIG. 12 shows the monitoring device from FIG. 11, comprising a first coupling point 48 in a power supply line of the first sensor 8*a*, to which coupling point activation signals can be applied by the second microprocessor 5, and comprising a second coupling point 49 in a power supply line of the second sensor 8*b*, to which coupling point activation signals can be applied by the first microprocessor 4.

FIGS. 10 to 12 also show embodiments of monitoring devices which comprise two sensors 8*a*, 8*b*, the output signals of which are redundantly supplied to the first and second microprocessor 4, 5.

FIG. 10 shows the monitoring device from FIG. 6, in which the two sensors 8*a*, 8*b* are each connected to the first microprocessor 4 via a first transmission line 21 and to the second microprocessor 5 via a second transmission line 22. A first coupling point 45, to which activation signals can be applied by the second microprocessor 5, is provided in the first transmission line 21, and a second coupling point 46, to which activation signals can be applied by the first microprocessor 4, is provided in the second transmission line 22.

FIG. 11 shows the monitoring device from FIG. 10, comprising only one coupling point 47, which is arranged in a common power supply line of the two sensors 8*a*, 8*b* and to which activation signals can be applied by the two microprocessors 4, 5. Furthermore, the first sensor 8*a* and the second 8*b* are in each case connected to the first microprocessor 4 via a first transmission line 23 and to the second microprocessor 5 via a second transmission line 24.

FIG. 12 shows the monitoring device from FIG. 11, comprising a first coupling point 48 in a power supply line of the first sensor 8*a*, to which coupling point activation signals can be applied by the second microprocessor 5, and comprising a second coupling point 49 in a power supply line of the second sensor 8*b*, to which coupling point activation signals can be applied by the first microprocessor 4. State changes can therefore be induced individually, simultaneously or alternately at both sensors 8*a*, 8*b*. Furthermore, the first sensor 8*a* and the second 8*b* are in each case connected to the first microprocessor 4 via a first transmission line 25 and to the second microprocessor 5 via a second transmission line 26.

In order to achieve maximum versatility, the two microprocessors 4 and 5 can communicate with the control unit 10 preferably independently of one another, and for this purpose preferably have different addresses. The control unit 10 can therefore sequentially test one and the other microprocessor 4 or 5 while the other microprocessor 5 or 4 monitors the associated sensor 8*b* or 8*a*, respectively.

Provided that other sensors are used which provide further options for bringing about a change of state, the circuit can be correspondingly adapted.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A monitoring device for a passenger transport system, comprising:

a sensor;

a control unit;

a bus; and a bus node, the control unit and the bus node being connected to the bus, the bus node including a first microprocessor and an inspection unit both in communication with the control unit, wherein data is transmitted from the control unit to the inspection unit and from the first microprocessor to the control unit, the first microprocessor including a first program module for detecting a state change of the sensor connected to an input of the first microprocessor and for spontaneously transmitting a corresponding state message to the control unit, the inspection unit including a second program module that, after receiving an instruction from the control unit, transmits an activation signal to a coupling point within the bus node to simulate the state change of the sensor, wherein the activation signal is at least one of superimposed on a sensor signal from the sensor and coupled into a power supply line connected to the sensor.

2. The monitoring device according to claim 1 wherein the inspection unit is implemented in the first microprocessor or in a second microprocessor.

3. The monitoring device according to claim 1 wherein the sensor emits the sensor signal as at least one of a digital sensor signal and an analog sensor signal at an output, and wherein the first microprocessor monitors the sensor signal for an occurrence of the state change.

4. The monitoring device according to claim 3 wherein the digital sensor signal includes an identification code associated with the sensor.

5. The monitoring device according to claim 1 wherein the inspection unit emits the activation signal as at least one of a digital activation signal and an analog activation signal at an output.

6. The monitoring device according to claim 5 wherein the activation signal includes at least one of a DC voltage pulse, a logic signal, and an AC voltage signal in a frequency range of 500 Hz to 2000 Hz.

7. The monitoring device according to claim 1 wherein the coupling point is arranged at:

within an output stage of the sensor;

within an input stage of the first microprocessor;

between the output stage of the sensor and the input stage of the first microprocessor;

at an input of the sensor;

inside the sensor; or inside a power supply line connected to the sensor.

8. The monitoring device according to claim 1 wherein the coupling point is a galvanic connection for galvanic coupling of the activation signal, a coupling capacitor for capacitive coupling of the activation signal, or a coil for inductive coupling of the activation signal.

9. The monitoring device according to claim 1 wherein the coupling point is a logic circuit for combining the sensor signal in digital form and the activation signal in digital form.

10. The monitoring device according to claim 9 wherein the logic circuit is an inverter that is switched by the activation signal.

11. The monitoring device according to claim 1 wherein the sensor includes a code-bearing element and a code-reading element, the code-reading element reading an identification code from the code-bearing element from contactless transmission and in response the code-reading element sending the sensor signal to the first microprocessor, and the coupling point being arranged at an input or an output of the code-reading element.

12. The monitoring device according to claim 11 wherein the code-bearing element and the code-reading element each have an induction loop, the code-reading element providing the code-bearing element with electromagnetic energy with contactless transmission by the induction loops and the code-bearing element transmitting the identification code to the code-reading element with contactless transmission by the induction loops.

13. A method for testing a monitoring device according to claim 1 comprising the steps of:

generating the instruction from the control unit to the inspection unit;

generating the activation signal from the inspection unit to the coupling point; and at the coupling point, at least one of superimposing the activation signal on the sensor signal and coupling the activation signal into a power supply line connected to the sensor.

14. The method according to claim 13 including the steps of:

emitting the activation signal from the inspection unit as at least one of a digital activation signal and an analog activation signal to the coupling point; and arranging the coupling point at within an output stage of the sensor, within an input stage of the first microprocessor, between the output stage of the sensor and the input stage of the first microprocessor, at an input of the sensor, inside the sensor, or inside a power supply line connected to the sensor.

15. The method according to claim 13 including coupling the activation signal into the coupling point by a galvanic connection, a coupling capacitor, or a coil.

16. The method according to claim 13 wherein the coupling point is a logic circuit and including combining the sensor signal in digital form and the activation signal in digital form in the logic circuit.

17. The method according to claim 16 wherein the coupling point is an inverter and including switching the logic with the activation signal.

18. A passenger transport system comprising the monitoring device according to claim 1.

* * * * *